United States Patent [19]

Thuries et al.

[11] 4,295,023

[45] Oct. 13, 1981

[54] GAS-BLAST CIRCUIT-BREAKER

[75] Inventors: Edmond Thuries, Pusignan; Pierre Vernat; Roger Sauvat, both of Villeurbanne, France

[73] Assignee: Delle-Alsthom, Villeurbanne, France

[21] Appl. No.: 48,120

[22] Filed: Jun. 13, 1979

[51] Int. Cl.[3] ..... H01H 33/14; H01H 33/82

[52] U.S. Cl. ..... 200/148 R; 200/145; 200/148 F

[58] Field of Search ..... 200/145, 148 R, 148 F, 200/148 D

[56] References Cited

U.S. PATENT DOCUMENTS

| | | | |
|---|---|---|---|
| 1,920,894 | 8/1933 | Ruppel | 200/148 F |
| 3,069,521 | 12/1962 | Roxburgh et al. | 200/148 R |
| 3,258,570 | 6/1966 | Sindahl et al. | 200/148 R |
| 3,356,810 | 12/1967 | Kessler | 200/148 R |
| 3,846,601 | 11/1974 | Leeds | 200/148 F X |

*Primary Examiner*—James R. Scott

*Attorney, Agent, or Firm*—Sughrue, Mion, Zinn, Macpeak & Seas

[57] ABSTRACT

A gas-blast circuit-breaker which includes several groups of arc-extinguishing chambers, each group being supported by a support above a base, each support including firstly support pillars fixed at various points of the base and secondly a tubular column which is suitable for conveying the gas of the circuit-breaker and which extend to a single actuator which is integral with the base, these columns including links controlled by the actuator and connected to control rods for opening and closing the arc-extinguishing chambers.

5 Claims, 8 Drawing Figures a
b
c
d
1a
2a
53a
55a
13a
4a
4b
4c
4d
5a
5b
5c
5d
6a
7
8a
8b
8c
8d
3
54
III
IV
VI
VIII
F

GAS-BLAST CIRCUIT-BREAKER

BACKGROUND OF THE INVENTION

1. Field of The Invention

The present invention relates to a gas-blast circuit-breaker and more particularly to a high-voltage gas-blast circuit-breaker, each of whose poles includes several groups of arc-extinguishing chambers, these groups being supported at the same horizontal level above the ground by a support formed by insulating columns or pillars fixed on a base.

2. Background of the Invention

In known devices, each group generally includes two or four aligned arc-extinguishing chambers and a control box disposed between the chambers. The gas in the control box communicates with the chambers and the control mechanism of the control box is connected to these chambers by control rods for opening and closing the circuit-breaker. The lower portion of the control box includes a plate to which is fixed the top of a tubular column whose base is fixed on a base which is perpendicular to the plate. The column is formed by a stack of insulators and contains the compressed gas which comes from a source situated at the level of the base so as to convey the gas towards the box and the arc-extinguishing chambers. The column also contains means for transmitting the force to operate the circuit breaker control rods, these means comprising axial links whose tops are articulated with the control rods. A set of horizontal links is disposed at the level of the base to connect the bases of the vertical links to the mechanism of an actuator, the vertical links being situated in the successive columns of the various groups.

Pillars which have only a supporting function and which therefore contain neither gas nor operating means can also be fixed between the base and the plates of the various groups so as to increase the stability of the device.

Circuit-breakers of this type have drawbacks.

Indeed, when the rated voltage of the circuit-breaker increases, the insulating support is longer and must have greater resistance to bending. For that purpose, keeping the dimensions of the various insulators of each column identical, these insulators can be made of materials which have different mechanical strength, so that the insulators situated at the base of the column will have improved mechanical strength. Also, still keeping the dimensions of the insulators of each column identical, insulating tie rods can be added to the insulators situated at the base of the column, the tie rods increasing the mechanical strength of the assembly. Also, insulators with a larger diameter or thicker insulators can be provided at the base of the column. But all cases lead to increasing the number of types of elementary insulators.

Further, a very long insulating support (several meters in length) which has a small diameter and whose end supports heavy arc-extinguishing chambers has less resistance to earthquakes.

Lastly, circuit-breakers of this type have the disadvantage of requiring a very long length of links.

When the circuit-breaker includes several modules which include supports several meters apart and supporting arc-extinguishing chambers in series, the arc-extinguishing units must have synchronized movements on closing and more especially on opening. This synchronization is difficult to obtain, since any play must be compensated and expansion and shrinkage of the connection links due to variations in temperature must be taken into account.

The present invention aims to mitigate these drawbacks and to control more simply and more accurately the opening and closing of gas-blast circuit-breakers which have several groups of arc-extinguishing chambers supported by insulating columns and pillars.

SUMMARY OF THE INVENTION

The present invention provides a gas-blast circuit-breaker which includes:

a horizontal base;

n groups of arc-extinguishing chambers, each group including at least two arc-extinguishing chambers which are connected by control rods to a control box disposed between the two chambers and integral therewith, the gas in the box communicating with the two chambers;

n supports fixed firstly respectively to n plates integral with the n control boxes and secondly to the base to support the n groups at the same horizontal level above the frame, the support of each group including:

a column in the form of a tube for conveying the gas necessary for operating the circuit-breaker and providing the gas-blast, the gas in the upper end of the tube communicating with the control box, the tube including links disposed axially and articulated with the control rods, the lower end of the column being fixed to an actuator which is integral with the base, the actuator including a chamber into which the lower end of the tube leads, the chamber being connected to a compressed gas source, the actuator also including controllable means for imparting a simultaneous axial movement to the lower ends of the links of the n groups so as to open and close the circuit-breaker; and supporting pillars which are capable only of supporting the arc-extinguishing groups, the lower ends of the pillars being fixed on the base outside the actuator.

BRIEF DESCRIPTION OF THE DRAWINGS

A particular embodiment of the present invention is described hereinbelow by way of an example with reference to the accompanying drawings in which.

DESCRIPTION OF THE PREFERRED EMBODIMENT

Figures 1, 2:
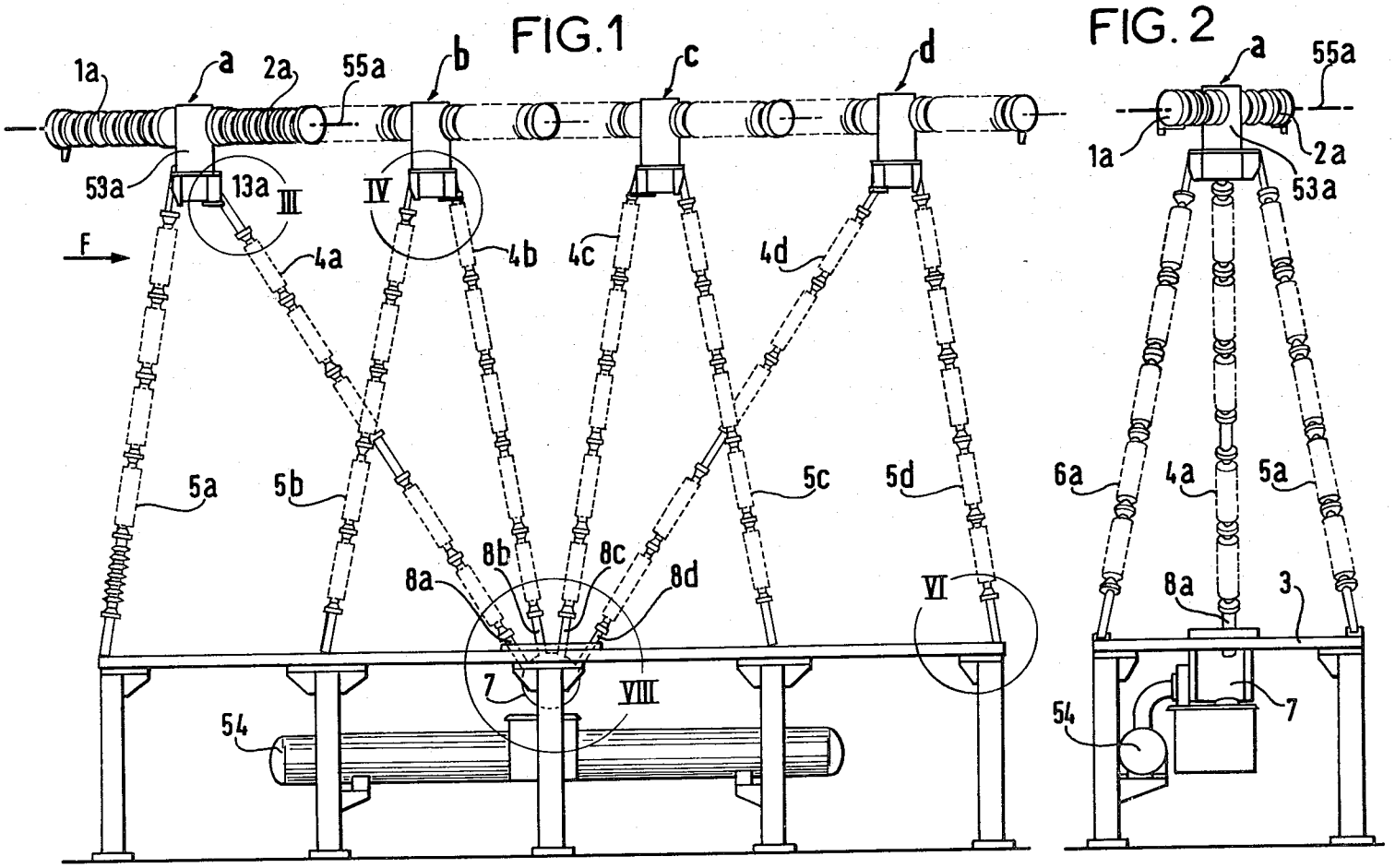
FIG. 1 illustrates longitudinally the outside of a pole of a circuit-breaker in accordance with the invention.
FIG. 2 illustrates an outside profile in the direction of the arrow F in FIG. 1 of the pole of the circuit-breaker illustrated in FIG. 1.

The circuit-breaker pole illustrated in FIGS. 1 and 2 includes four groups of two arc-extinguishing chambers. For example, group "a" has two chambers 1*a* and 2*a* disposed on either side of a control box 53*a* along an axis 55*a*, the gas in the control box communicating with the chambers 1*a* and 2*a*. The axes such as 55*a* of the four groups are parallel to one another and disposed at the same horizontal level above the ground. A plate 13*a* integral with the lower part of the box 53*a* is installed on a three-legged support fixed on a horizontal base 3.

The support includes firstly a hollow or tubular insulating column 4*a* whose ends are fixed respectively to the plate 13*a* and to the end of a tube 8*a* which is integral with an actuator 7 fixed in the centre of the horizontal surface of the base 3. The support also includes two solid insulating pillars 5*a* and 6*a* the ends of which are fixed respectively to the plate 13*a* and to the base 3 outside the actuator 7. The bases of the two pillars and that of the column 4*a* are therefore disposed at the apex of a triangle of the horizontal upper board of the base 3.

Like group a, the three other groups b, c and d of the circuit-breaker pole illustrated each have a control box provided with a plate installed on a three-legged support. The support of each group has a tubular column such as 4*b*,4*c* and 4*d* whose base is fixed to the end of a tube such as 8*b*, 8*c* or 8*d* integral with the actuator 7. The columns 4*a*, 4*b*, 4*c* and 4*d* are preferentially situated all in the same vertical plane.

The support of each group further includes two pillars whose bases are fixed on the board of the base 3 outside the actuator 7.

A source of compressed gas such as a tank 54 is connected to the actuator 7.

Figure 3:
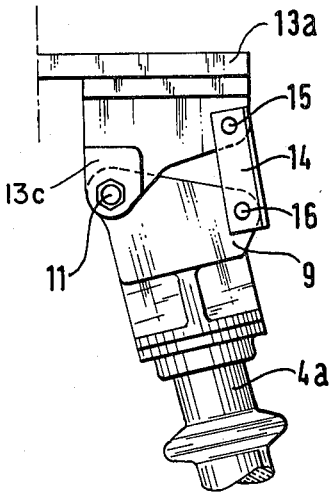
FIG. 3 illustrates the detail III of FIG. 1, on a larger scale.
Figure 5:
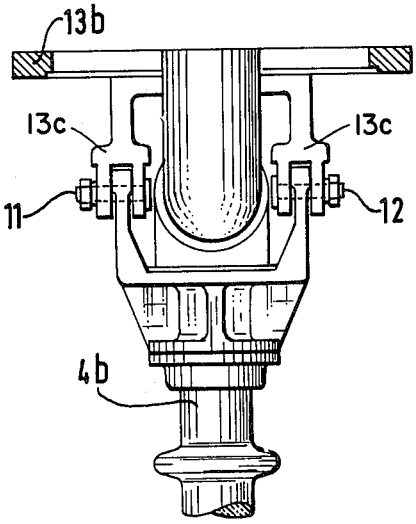
FIG. 5 is a cross-section along the plane V—V of FIG. 4.
Figure 4:
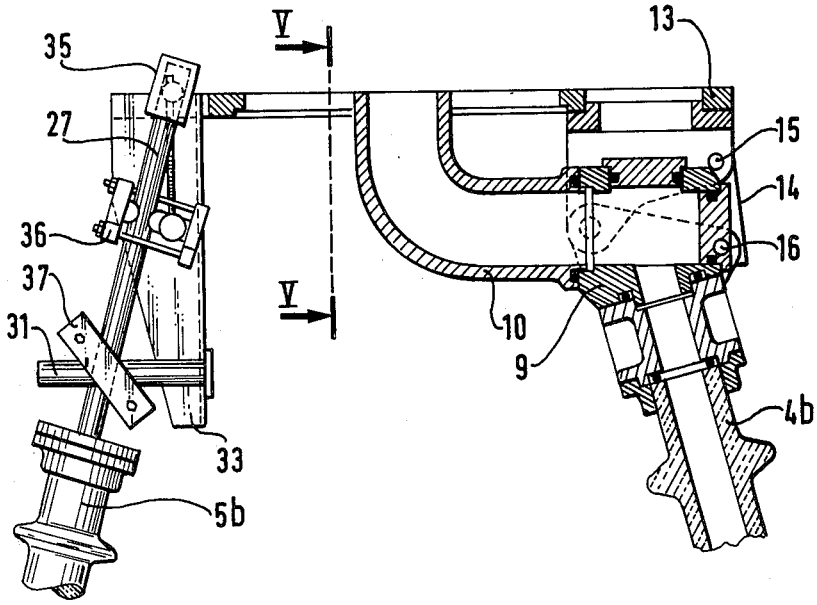
FIG. 4 is a cross-section of the detail IV of FIG. 1.

FIGS. 3,4 and 5 show more precisely the fixing of the tubular columns on the plate of the control box of each group. The top of each column 4*a* includes a sealed receptacle 9. As shown in FIG. 4, the receptacle 9 communicates firstly with the inside of the insulating tube which constitutes the column 4*b* and secondly, via a tube 10, with the control box (not shown) of the group, i.e. 53*a*. To simplify the figures, the control links in FIG. 4 which are disposed longitudinally in each column between the actuator 7 and the receptacle 9 have not been shown, the control links being articulated with control rods for opening and closing the arc-extinguishing units of the chambers. The ends of these control rods which enter the control box i.e. 53*a*, are connected by a succession of mechanical transfer means disposed in the tube 10 and in the receptacle 9, to the corresponding ends of the control links. The receptacle 9 is articulated to rotate at 11 and 12 about a horizontal axis by two shoulders 13*a* integral with the plate 13*b*. The column 4*b*which is capable of rotating about the axis is immobilized by means of one or several connecting parts such as 14 fixed firstly at 15 to the shoulder of the plate and secondly at 16 to the receptacle 9. Since the orientation of the columns differs according to the group considered, the distance between the fixing points 15 and 16 varies; so as to adapt the length of the part 14 as required, connecting parts can be used which have one fixing hole 15 and several holes 16 or connecting parts with different lengths can be used.

Figure 6:
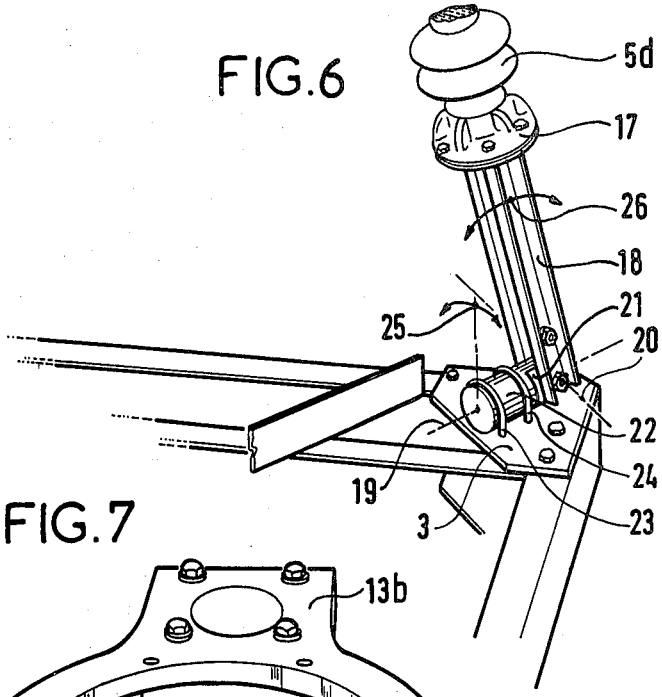
FIG. 6 illustrates in perspective the detail VI of FIG. 1.

The fixing of the pillars such as 5*d* on the base 3 is shown in FIG. 6. The base 17 of the column 5*d* is fixed on a support 18 formed for example by two assembled U-shaped metal parts. The support 18 is also articulated rotatably about an axis 20 on the flattened portion 21 of a shaft 22 which is itself fixed on the base 3 by two collars 23 and 24. This disposition allows the shaft 22 to be rotated about its horizontal axis 19 as shown by the arrows 25 and the axis of the column 5*d* to be rotated about the axis 20 in the plane defined by the axis 19 and that of the column 5*d* as shown by the arrows 26. Thus, the axis of the column 5*d* can rotate about two axes 19 and 20 which intersect each other perpendicularly and can occupy any position inside a cone whose apex is at the intersection of the axes 19 and 20.

Figure 7:
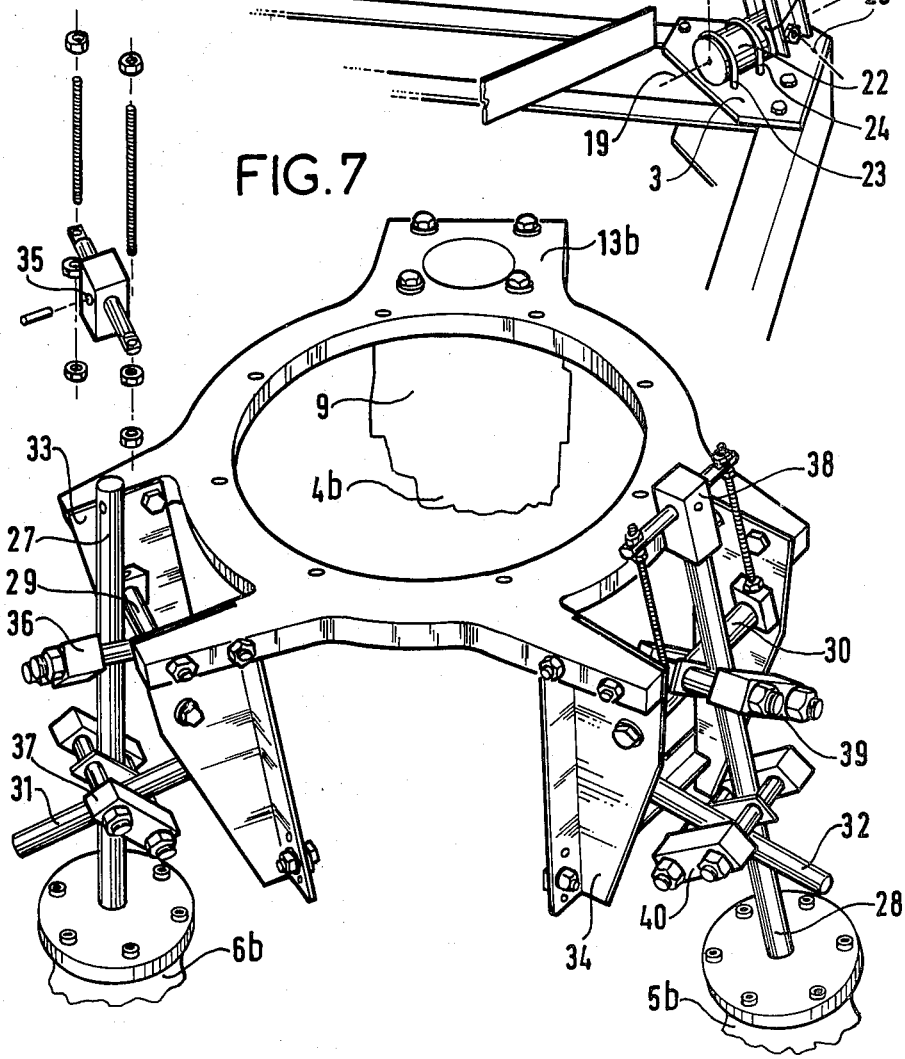
FIG. 7 is a partial perspective illustration of the device of FIG. 4.

FIG. 7 is a perspective view of the fixing of the pillars such as 5*b* and 6*b* on the plate which is integral with the control box of a group of chambers. The plate 13*b* is supported by the top of the column 4*b* and held in the horizontal position after the connecting part 14 (FIG. 3) has been adjusted. The two pillars 5*b* and 6*b* only allow the support of the plate 13*b* to be reinforced. In particular, unlike the columns such as 4*b*, they include no control mechanism for opening and closing the arc-extinguishing units of the chambers. As shown in FIG. 7, the tops of the pillars 5*b* and 6*b* can be provided with rods 28 and 27 which are applied respectively firstly, on stops 30 and 29, then on stops 31 and 32 which are integral with supports 34 and 33 fixed on the plate 13*b*. The rods 28 and 27 are thus applied after suitable rotation of the pillars about their axes such as 19 and 20 (FIG. 6). After the collars 23 and 24 (FIG. 6) have been tightened, the upper rods of the pillars are fixed to the stops by fixing units such as 35, 36 and 37 for the column 6*b*. This disposition makes it possible to reduce the hyperstatic stresses on the three-legged supports such as 4*b*, 5*b* and 6*b*.

Figure 8:
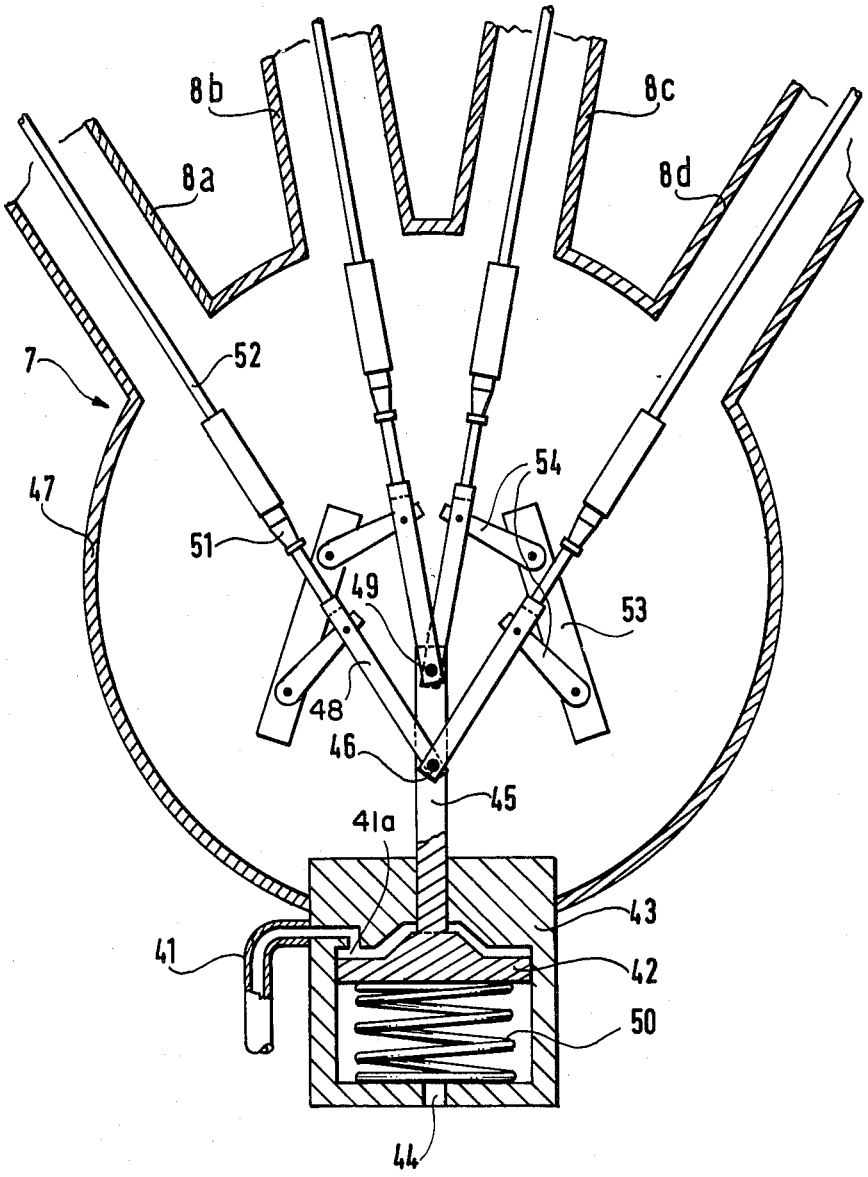
FIG. 8 is a schematic cross-section of the detail VIII in FIG. 1.

As stated previously, control links for opening and closing are disposed in the columns 4*a* to 4*d*. FIG. 8 shows, by way of an example the circuit-breaker opening controlled by the actuator 7 which includes a cylindrical chamber 47 connected to the tank 54. The previously mentioned tubes 8*a* to 8*d* start from the chamber 47. The ends 52 of the opening links are articulated by means of a length adjusting device such as 51 and of a rod 48 on a vertical rod 45. It is seen that the extensions of the links disposed in the columns 4*a* and 4*d* are articulated at a point 46 of the rod 45, while the extensions of the links disposed in the columns 4*b* and 4*c* are articulated at a point 49 of the rod 45, the point 49 being above the point 46. A mechanical device which connects the rods 48 together and is constituted by two levers such as 53 and four connecting rods such as 54 allows the links to be guided in the axial part of the columns. The rod 45 controls the movement of a piston 42 in a vertical cylinder 43 situated at the lower portion of the chamber 47. A return spring 50 is disposed between the lower surface of the cylinder 43 and the piston 42. An opening 44 in communication with the atmosphere is formed at the lower portion of the cylinder 43, while the upper portion of the cylinder is provided with an opening 41.

When an order to open is emitted, a gas-blast device (not shown) connects the orifice 41*a* situated above the piston 42 for a short instant to a gas pressure source such as 54. The piston 42 is lowered towards the bottom of the cylinder 43. This causes simultaneous downward axial movement of the links. The movement is transmitted to the control rods so as to open simultaneously the valves which control the opening of the arc-extinguishing units and the blasting and extinguishing of the arcs in all the arc-extinguishing chambers of the circuit-breaker pole. After the opening, the piston rises into the cylinder under the effect of the spring 50, the cut-out switches of the chambers remaining open.

Of course, other control links (not shown) are disposed inside the columns 4*a* to 4*d* and are connected to other control rods of the arc-extinguishing chambers to close the arc-extinguishing units of these chambers by operating the valves situated near the chambers. These closing links are actuated by a gas-blast system analogous to the one which has just been described.

The circuit-breaker in accordance with the invention has the following advantages:

improved synchronization of the opening and of the closing of the arc-extinguishing chambers by grouping the mechanical controls at one point and by correlative reduction of play;

reduction of the transmission time of the opening and closing orders; and shortening of the length of the control links.

These advantages are obtained by means of high-resistance insulating supports which each include several columns or pillars, which undergo tensile stress but no bending stress. In the preferred embodiment described above, the circuit-breaker in accordance with the invention has the extra advantage of reducing the hyperstatic stresses on the supports in comparison with those of circuit-breakers of the prior art.

We claim:

1. A gas-blast circuit-breaker, said circuit-breaker including for each pole, a horizontal base, a control box, an actuator chamber secured to said base, a plurality of groups of arc-extinguising chambers, each group including at least two arc-extinguishing chambers, each arc-extinguishing chamber including an opening unit and a closing unit, arc-extinguishing chambers being electrically connected in series, each group including a support assembly, said support assembly comprising a plate, said control chamber fixed to said plate, said arc-extinguishing chambers being fixed to said control chamber and opening thereto, two insulating pillars extending between said plate and said base and being secured to said base, said column being fixed at one end to said plate and communicating through said plate with the interior of said arc-extinguishing chamber via said control box, said column being abutting at its other end to said actuator chamber and being secured thereto and communicating with the inside of said actuator chamber, said hollow column including rod means extending longitudinally interiorly thereof and controlling said opening and closing units, a compressed gas source connected to said actuator chamber for supplying compressed air via said actuator chamber and said hollow insulated column to said arc-extinguishing chambers and said actuator chamber including means for imparting simultaneous axial movement of said rod means so as to simultaneously open and close all of said opening and closing units of said plurality of groups of arc-extinguishing chambers.

2. The gas-blast circuit-breaker according to claim 1 wherein said columns are disposed in the same vertical plane, each column being secured at its upper part through a terminal sealed receptacle in communication with an arc-extinguishing chamber through a hole in said receptacle and being secured to said plate by means of a horizontal pivot connection and means for fixing the angular position of said column by locking said pivotably mounted sealed receptacle to said plate.

3. The gas-blast circuit-breaker according to claim 2, further comprising means for pivotably mounting the lower ends of said pillars to said base for articulation about two perpendicular axes.

4. The gas-blast circuit-breaker according to claim 3, further comprising means for adjustably fixing the tops of said pillars to said plate about said two perpendicular axes so as to immobilize the upper ends of said pillars and being fixed to said plate at points remote from the connection between said hollow insulated column and said plate and at an angular relationship dominated by the pivotable connection between said terminal sealed receptacle and said plate.

5. The gas-blast circuit-breaker according to claim 1, wherein said actuator chamber is cylindrical and said columns lead radially into said actuator chamber.

* * * * *